US012539009B2

(12) United States Patent
Baszak et al.

(10) Patent No.: US 12,539,009 B2
(45) Date of Patent: Feb. 3, 2026

(54) SQUEEGEE WITH APPLICATOR SPONGE, HANDLE, LID AND CONTAINER WITH LOCKING TABS

(71) Applicants: Arthur Lucian Baszak, Toronto (CA); John Baszak, Toronto (CA); Luke Baszak, Toronto (CA)

(72) Inventors: Arthur Lucian Baszak, Toronto (CA); John Baszak, Toronto (CA); Luke Baszak, Toronto (CA)

(73) Assignee: Arthur Lucian Baszak, Toronto (CA)

( * ) Notice: Subject to any disclaimer, the term of this patent is extended or adjusted under 35 U.S.C. 154(b) by 0 days.

(21) Appl. No.: 18/408,941

(22) Filed: Jan. 10, 2024

(65) Prior Publication Data

US 2024/0341558 A1 Oct. 17, 2024

(30) Foreign Application Priority Data

Apr. 4, 2023 (CA) ..... 3194983

(51) Int. Cl.
*A47L 13/11* (2006.01)
*A47L 13/51* (2006.01)

(52) U.S. Cl.
CPC ..... *A47L 13/11* (2013.01); *A47L 13/51* (2013.01)

(58) Field of Classification Search
CPC ..... A47L 13/11; A47L 13/51
See application file for complete search history.

(56) References Cited

U.S. PATENT DOCUMENTS 6,854,910 B2 * 2/2005 Leblanc ..... B60S 3/045 D32/45
7,311,458 B2 * 12/2007 Verlin ..... A47L 13/51 401/38
8,677,549 B2 * 3/2014 Fields ..... B60S 3/045 206/207

FOREIGN PATENT DOCUMENTS

CA 2402951 A1 * 3/2004 ..... A47L 1/06
CA 2483132 A1 * 3/2006 ..... A47L 1/06

* cited by examiner

*Primary Examiner* — Jennifer C Chiang

(57) ABSTRACT

Squeegee with applicator sponge and handle, attached to a removable lid and having a container holding cleaning or vehicle wiper fluid. Container will have an aperture permitting the squeegee with applicator sponge and handle and removable lid to extend into the container accessing and removing the cleaning or wiper fluid. The lid and container will be attached with locking devices. Gaskets to be on container, lid, and handle to assist container in being leak resistant. Container will be portable with an attached carrying handle.

6 Claims, 6 Drawing Sheets

SQUEEGEE WITH APPLICATOR SPONGE, HANDLE, LID AND CONTAINER WITH LOCKING TABS

1—BACKGROUND OF THE INVENTION

This invention relates to a squeegee with applicator sponge, handle, lid and container with locking tabs (henceforth referred to as SWASHLC). The SWASHLC is commonly used to apply a cleaning liquid by the sponge and "squeegee" (remove) the liquid and dirt from predominantly glass surfaces. It is most used on the windows of vehicles and buildings. The SWASHLC may comprise of rubber or polyester, plastic or other similar materials used in its manufacture.

2—PRIOR ART

It is known that prior art shows different uses of operation and construction of a squeegee container and it's parts.

U.S. Pat. No. 5,960,513
Date of Patent: Oct. 5, 1999
Beshah, Paul

Beshah discloses a squeegee apparatus comprising of a container for holding washing or cleaning fluid. This prior art has a limitation to its use as it is made to be permanently installed at a location. The invention submitted in this application speaks to its different use as a portable container that can be carried from its storage area and to the area it is required to be used at.

The following prior art descriptions are from patent applications.

Patent application CA 2402951
Lafleche, Martin G
Status of application: DEAD
Patent application CA 2393424
Leblanc, Gilles
Status of application: DEAD
Patent application CA 2483132
Watson, Reginald
Status of application: DEAD

3—SUMMARY OF THE INVENTION

The application envisioned for this invention would see it utilized to clean vehicle windows, headlights, brake light lenses etc. in all seasons. Currently drivers are only able to clean their windows, headlights etc at a gas station equipped with a squeegee station. The liquid available is usually dirty, oily or slushy in the winter. Worse yet the squeegee station may be empty of fluid and its squeegee may be in disrepair. This inventions portability with having a carrying strap on the cleaning fluid filled container ensures that it's convenience will be available anywhere, anytime a driver requires it, ensuring visibility for the driver and safety for others on the road. After cleaning, the driver's vehicle brake lights will be cleaner and more visible to vehicles behind, headlights able to project their beams farther onto the roadway, and windows cleaner ensuring a safer driving environment for all. The morning after a winter storm is particularly challenging for drivers. The storm may have ended but has left an accumulation of snow, salt, and water spray on the driver's vehicle. For those driver's, especially those driving "into the sun" the cleaning of side windows and windshield with the SWASHLC would ensure a glare free ride. The sponge portion of the SWASHLC may also be used in conjunction with a cleaning cloth to clean the driver's door mirrors.

Although this invention, the SWASHLC has been described in a wide scope it should be understood the description made by example information and drawings and that the invention is not limited to the features described but includes all variations and modifications (IE construction materials dimensions and manufacturing techniques etc) that does not depart from the scope of the invention as described in the claims.

4—DESCRIPTIVE DRAWINGS OF THE INVENTION

Four drawings are provided in the description. The describing part numbers are numbered 1 to 16.

1—Handle
2—Handle sleeve
3—Handle stem
4—Lock collar with gasket
5—Lid
6—Squeegee/sponge holder assembly
7—Nylon mesh
8—Sponge scrubber
9—Acme thread
10—Squeegee head
11—Side lock tabs
12—Gasket embedded in the container edge.
13—Container body
14—Container handle with indent 14A and detent 14B
15—Non skid feet
16—Container aperture FIGS. 1A and 1B show the overall construction of the SWASHLC.

Figure 1:
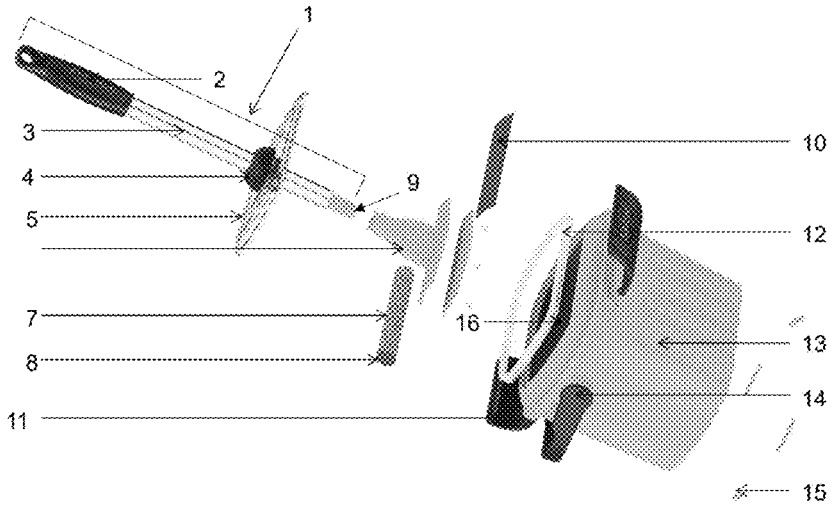
FIG. 1A shows the handle (1) comprising of the handle sleeve (2) handle stem (3) lock collar with gasket (4) lid (5) squeegee/sponge assembly (6) nylon mesh (7) foam scrubber (8) and the acme thread (9).
FIG. 1B shows the container portion of the invention. The container consists of the container body (13) container aperture (16) container handle with indent and detent (14) gasket embedded in the container edge (12) side lock tabs (11) and non-skid feet (15).
Figure 2A:
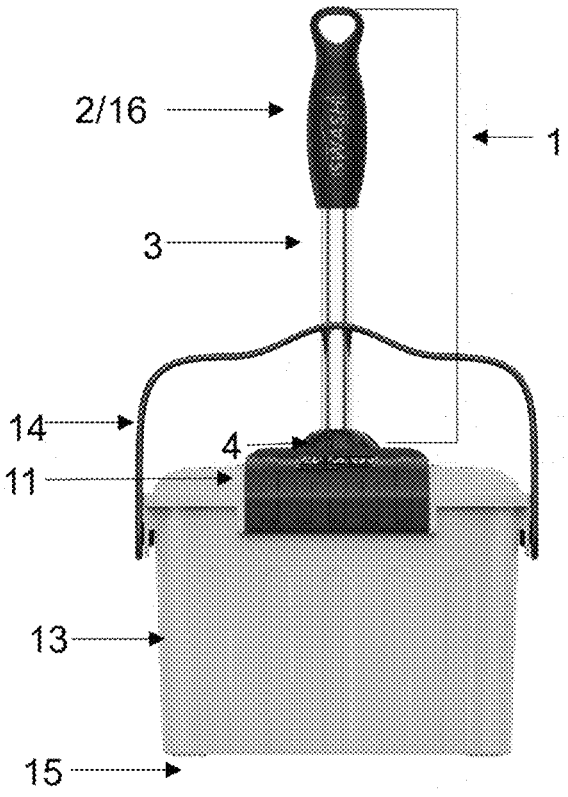
Figure 2B:
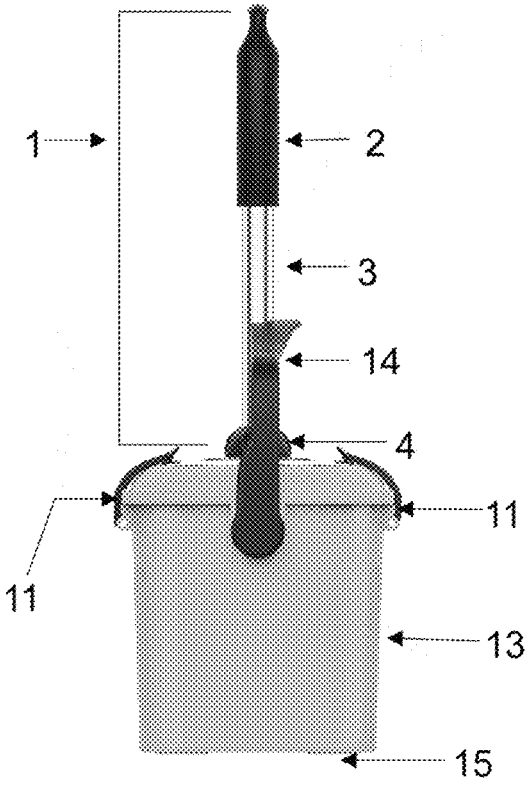
Figure 2C:
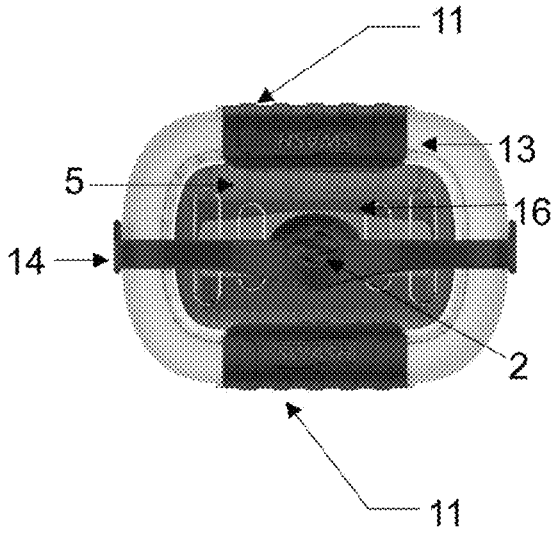

FIGS. 2A, 2B, and 2C show the overall construction of the SWASHLC in a "standby" position.

FIG. 2A frontal view (closed position) shows the container body (13) container handle (14) side lock tabs (11) non-skid feet (15) and handle (1) incorporating the handle sleeve (2) handles stem (3) and the lock collar (4). For clarity of the picture parts 5,6,7,8,9,10,12 and 16 are not shown.

FIG. 2B side view (closed position) shows the container body (13) container handle (14) 2 side lock tabs (11) non-skid feet (15) and handle (1) incorporating the sleeve handle (2) handle stem (3) and the lock collar (4). For clarity of the picture parts 5,6,7,8,9,10,12 and 16 are not shown.

FIG. 2C top view (closed position) shows the container body (13) handle sleeve (2) lock collar (4) lid (5) side lock tabs (11) container handle aperture (16). For clarity of the picture parts 1,3,6,7,8,9,10,12 and 15 are not shown.

Figure 3:
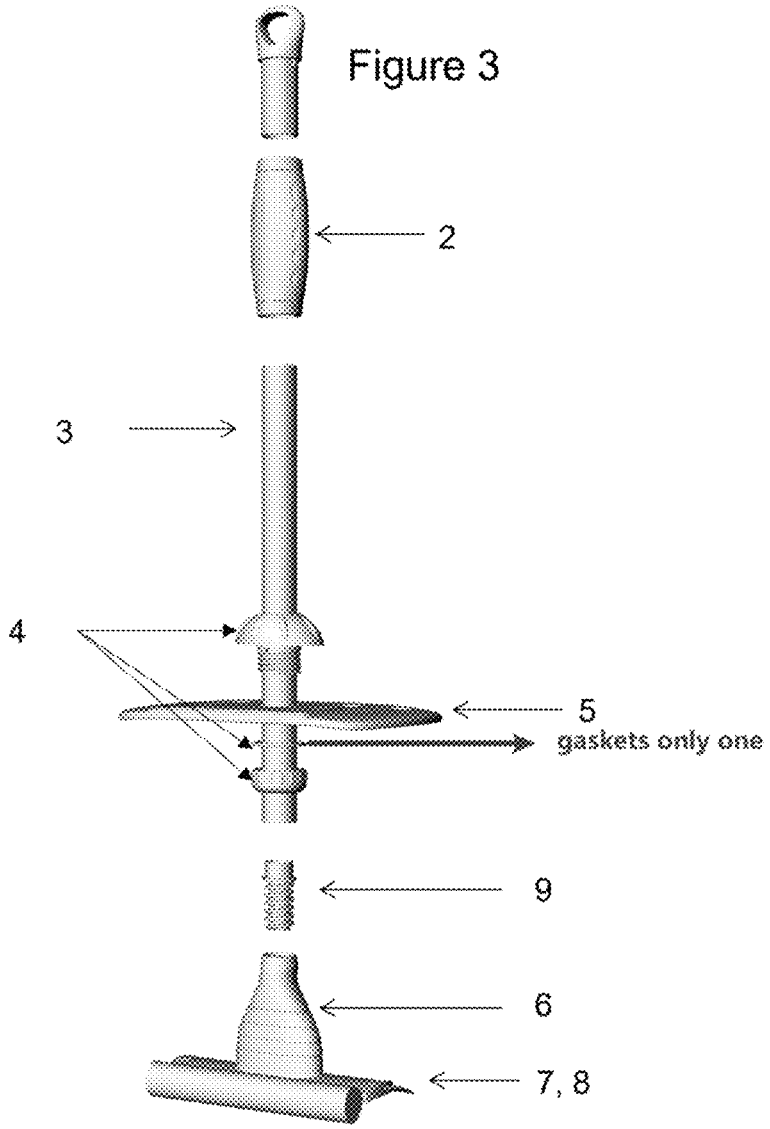

FIG. 3 shows the overall construction of the handle and attached parts. The handle (1) comprising of the handle sleeve (2) handle stem (3) upper portion of the lock collar with gasket (4) are pushed through the lid (5). The gasket and lower portion of the lock collar are tightened against the lid creating a leak resistant seal. The acme thread (9) is attached to the handle (1) and the squeegee/assembly (6)

which incorporates the nylon mesh (7) sponge scrubber (8) and squeegee head into the final assembly of the handle.

Figure 4:
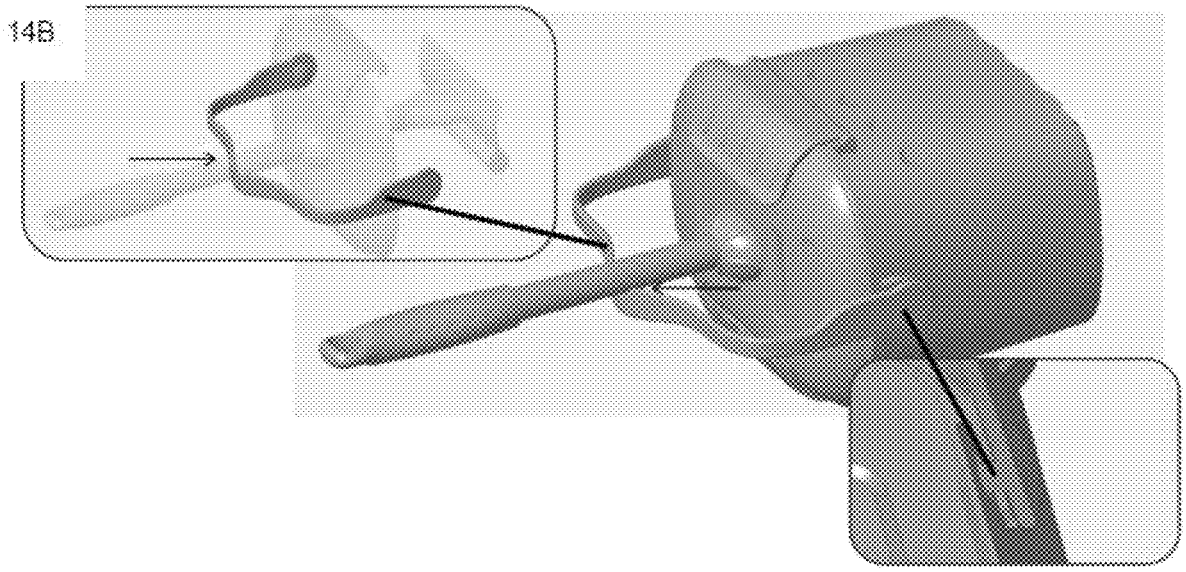

FIG. 4 shows all parts as in FIGS. 2A, 2B and 2C including enlarged views of the container handle with indent (14A) to clip onto handle (1) and view of the container handle with indent (14B) to restrict movement of handle to 90 degrees of operation and enable it to be snapped into a locked position.

Operation if the SWASHLC Consists of the Following Steps:

Step 1—preparation—the 2 side lock tabs (11) are placed in an unlocked position. The handle assembly ("the handle") consisting of parts 1,2,3,4,5,6,7,8,9 and 10 is removed from the container body (13) and windshield wiper cleaning fluid or the cleaning fluid of choice is poured into the container body (13) through the container aperture (16). "The handle" is now placed back into the container body and the side lock tabs (11) are placed in the lock position. The SWASHLC is now ready for use.

Step 2—use—when the condition arises to clean the operator simply unlocks the side lock tabs (11) removes "the handle" and uses it to clean a vehicles window, headlights, mirrors, brake lights etc and uses the squeegee portion to remove the cleaning fluid. If additional fluid is required "the handle" is placed back into the container body (13) through the container aperture (16) and used to clean again. When no further use is required "the handle" is placed back into the container body (13) through the container aperture (16) and the side lock tabs are placed (11) in the lock position. The side lock tabs (11) compress the lid (5) onto the container gasket (12) to create a leak resistant seal. The entire SWASHLC may be carried around a vehicle when cleaning making it very portable.

What is claimed is the squeegee apparatus comprising of:

1. A squeegee storage system comprising:

a container comprising a container body to hold a vehicle wiper fluid, a top portion of the container body having an opening to removably store a squeegee, a gasket embedded in the top portion surrounding the opening, a handle connected to the container body, and snap-fit latches near the top portion;

a squeegee comprising an elongated stem, one end of the elongated stem is attached to a sponge applicator, the other end is configured as a handle, a mid-section of the stem is attached to a lid fitted with a collar gasket;

wherein the squeegee is removably stored in the container such that in a storage position, the lid fits into the opening in the top portion of the container body, the squeegee handle is positioned vertically outside of the container top portion and the snap-fit latches secure the lid to the container and the gaskets provide a leak-resistant seal;

wherein to use the squeegee, the snap-fit latches are undone to allow the squeegee to be removed from the container.

2. The squeegee apparatus of claim 1, wherein the vehicle wiper fluid is configured to clean windows, headlights, and brake lights.

3. The squeegee apparatus of claim 1, wherein the container is directly attached to the handle such that the applicator sponge can apply the wiper fluid accessed through the aperture to the surface being cleaned.

4. The squeegee apparatus of claim 1, wherein the plurality of snap-fit latches includes at least two snap-fit latches.

5. The squeegee apparatus of claim 1, further comprising a squeegee blade attached to the handle opposite a nylon covered applicator sponge for removing excess fluid from the windows, headlights and brake lights.

6. The squeegee apparatus of claim 1, wherein the container includes a carrying handle having an indent configured to snap onto the handle, facilitating portability of the single unit, and non-skid feet configured to provide stability when placed on a surface.

* * * * *